US012507837B2

(12) United States Patent
Gordon et al.

(10) Patent No.: US 12,507,837 B2
(45) **Date of Patent: *Dec. 30, 2025**

(54) DISPENSING DEVICE WITH REPLACEABLE FRONT COVER

(71) Applicant: Kimberly-Clark Worldwide, Inc., Neenah, WI (US)

(72) Inventors: Alice S. Gordon, Roswell, GA (US); Eric M. Chalko, Alpharetta, GA (US); Phillip L. Hutchison, Lebanon, OH (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 232 days.

This patent is subject to a terminal disclaimer.

(21) Appl. No.: 17/771,399

(22) PCT Filed: Jul. 1, 2020

(86) PCT No.: PCT/US2020/040503

§ 371 (c)(1),
(2) Date: Apr. 22, 2022

(87) PCT Pub. No.: WO2021/086452

PCT Pub. Date: May 6, 2021

(65) Prior Publication Data

US 2022/0386829 A1 Dec. 8, 2022

Related U.S. Application Data

(63) Continuation of application No. PCT/US2019/059000, filed on Oct. 31, 2019.

(51) Int. Cl.

| | |
|---|---|
| ***A47K 10/36*** | (2006.01) |
| ***A47K 10/32*** | (2006.01) |
| ***A47K 10/38*** | (2006.01) |

(52) U.S. Cl.
CPC ..... *A47K 10/3625* (2013.01); *A47K 10/36* (2013.01); *A47K 10/38* (2013.01);
(Continued)

(58) Field of Classification Search
None
See application file for complete search history.

(56) References Cited

U.S. PATENT DOCUMENTS

| | | | |
|---|---|---|---|
| 2,930,664 | A | 3/1960 | Liebisch |
| 3,902,637 | A | 9/1975 | Scheeler |

(Continued)

FOREIGN PATENT DOCUMENTS

| | | | |
|---|---|---|---|
| CN | 2540118 | Y | 3/2003 |
| CN | 201384453 | Y | 1/2010 |

(Continued)

OTHER PUBLICATIONS

Alibaba, "Billboard Clamp Facial Tissue Dispenser—Buy Facial Tissue Dispenser, Plastic Tissue Dispenser, Facial Tissue Dispenser Product on Alibaba.com", https://www.alibaba.com/product-detail/Billboard-clamp-facial-tissue-dispenser_686500477.html.

(Continued)

*Primary Examiner* — Timothy R Waggoner
(74) *Attorney, Agent, or Firm* — Dority & Manning, P.A.

(57) ABSTRACT

A dispenser for sheet materials is disclosed. The dispenser includes a housing having an including a cover assembly, a back frame member comprising a first side and a second and opposite side forming an interior surface of the housing, and the first side of the back frame member comprising at least one mating receptor; and a plate comprising a carrier member primarily made from plastic and a decorative facia, wherein the carrier member has a facia side coupled to the decorative facia and a back and opposite side, including a locking element, wherein the plate is configured to be (Continued)

removably coupled to the first side of the back frame member when the locking element of the carrier member is releasably engaged to the mating receptor of the back frame member such that the decorative facia forms an exterior surface of the dispenser.

26 Claims, 12 Drawing Sheets

(52) U.S. Cl.
CPC ..... *A47K 2010/3233* (2013.01); *A47K 2010/3246* (2013.01); *A47K 2010/389* (2013.01)

(56) References Cited

U.S. PATENT DOCUMENTS

| | | | | |
|---|---|---|---|---|
| 4,487,375 | A | 12/1984 | Rasmussen et al. | |
| 4,915,316 | A | 4/1990 | Bastian | |
| 5,261,557 | A | 11/1993 | Bytell et al. | |
| 6,170,698 | B1 | 1/2001 | Phelps et al. | |
| 7,426,695 | B1 | 9/2008 | Massaro et al. | |
| 7,490,733 | B2 | 2/2009 | Tagliareni | |
| 8,511,762 | B2 * | 8/2013 | Stegerwald | A47L 15/4251 312/265.6 |
| 9,067,754 | B2 | 6/2015 | Petersen et al. | |
| 9,858,748 | B2 * | 1/2018 | Thompson | A63F 13/25 |
| 10,136,768 | B2 | 11/2018 | Arlemark et al. | |
| 10,143,340 | B2 | 12/2018 | Allard et al. | |
| 10,321,792 | B2 | 6/2019 | Kennedy | |
| 12,150,598 | B2 * | 11/2024 | Gordon | A47K 10/3625 |
| 2003/0067254 | A1 | 4/2003 | Manke et al. | |
| 2005/0223486 | A1 * | 10/2005 | Jumalon | A47B 77/06 4/619 |
| 2006/0102641 | A1 * | 5/2006 | Cittadino | A47K 10/422 221/45 |
| 2007/0119858 | A1 | 5/2007 | Ayoub | |
| 2008/0203870 | A1 | 8/2008 | Riley et al. | |
| 2009/0120950 | A1 | 5/2009 | Titas et al. | |
| 2009/0153004 | A1 * | 6/2009 | Han | D06F 39/12 312/228 |
| 2011/0089790 | A1 | 4/2011 | Lee et al. | |
| 2014/0323212 | A1 | 10/2014 | Thompson et al. | |
| 2015/0101954 | A1 | 4/2015 | Pierson Jones | |
| 2016/0113448 | A1 | 4/2016 | Larsson et al. | |
| 2016/0373844 | A1 | 12/2016 | Owens | |
| 2018/0028027 | A1 | 2/2018 | Kendall et al. | |
| 2018/0132676 | A1 * | 5/2018 | Thomas | G06Q 90/00 |
| 2018/0353017 | A1 * | 12/2018 | Miranda | A61L 2/10 |
| 2019/0021557 | A1 | 1/2019 | Allard et al. | |
| 2023/0251024 | A1 | 8/2023 | Wang et al. | |

FOREIGN PATENT DOCUMENTS

| | | | |
|---|---|---|---|
| CN | 201384454 | Y | 1/2010 |
| CN | 202738122 | U | 2/2013 |
| CN | 206350101 | U | 7/2017 |
| CN | 107205592 | A | 9/2017 |
| DE | 4315097 | A1 | 11/1993 |
| KR | 101105553 | B1 | 1/2012 |
| KR | 20140000505 | U | 1/2014 |
| TW | M332408 | U | 5/2008 |
| WO | 2011044224 | A2 | 4/2011 |
| WO | 2014185843 | A1 | 11/2014 |

OTHER PUBLICATIONS

Surefresh, "Surefresh Wet Tissue Dispenser—Touch Display", https://www.amazon.in/Surefresh-Wet-Tissue-Dispenser-Display/dp/B01BM5GG72.

* cited by examiner

DISPENSING DEVICE WITH REPLACEABLE FRONT COVER

The present patent application claims priority to co-pending application PCT/US2019/059000, filed Oct. 31, 2019, and incorporates by reference the entire content thereof.

BACKGROUND

Washrooms in commercial and residential buildings typically include products such as toilet tissue, paper towels, diapers, feminine products, liquid products such as soap, and aerosol products such as air fresheners. These products are typically housed by a dispenser and are dispensed as needed by the user.

However, these dispensers are often ubiquitous in appearance offering only a few, if any, styling options during the purchase process. For example, if a building owner desires to update the décor of a washroom it is often necessary to remove the dispenser, which can damage the wall from which the dispenser was hanging and necessitate repairs (and discarding a perfectly good dispenser), and buy and install another dispenser better matched to the updated décor. This is an expensive and labor-intensive process.

SUMMARY

In general, the present disclosure is directed to a dispenser for a sheet material, such as paper towels, that has a modular front plate design that can be installed and/or removed at the end-user level including for installed dispensers, e.g., without having to removing dispensers from the walls on which they are mounted. The modular dispenser front plate design, for instance, can be modified only by access to the interior of the housing of the dispenser and can have a variety of different external materials/aesthetics.

In one aspect, the disclosure is directed to a dispenser for sheet materials comprising a housing having an interior volume configured to hold sheet material, the housing primarily made from plastic and including a cover assembly, wherein the cover assembly comprises a back frame member comprising a first side and a second and opposite side, the second side of the back frame member forming an interior surface of the housing, and the first side of the back frame member comprising at least one mating receptor; and a plate comprising a carrier member primarily made from plastic and a decorative facia, wherein the carrier member has a facia side coupled to the decorative facia and a back and opposite side, including a locking element, wherein the plate is configured to be removably coupled to the first side of the back frame member when the locking element of the carrier member is releasably engaged to the mating receptor of the back frame member such that the decorative facia forms an exterior surface of the dispenser. Other aspects include corresponding methods.

In another aspect, the disclosure is directed to a method comprising opening a cover of a dispenser housing of a dispenser, wherein the dispenser housing has an interior volume configured to hold sheet material, wherein the housing is made primarily from plastic and wherein the cover comprises a back frame member comprising a first side and a second and opposite side, the second side of the back frame member forming an interior surface of the housing, and the first side of the back frame member comprising at least one mating receptor; and removing a front plate, comprising a carrier member primarily made from plastic and a decorative facia, from the cover, wherein the carrier member has a facia side coupled to the decorative facia and a back and opposite side, including a locking element, and the front plate is releasably attached to the first side of the back frame member when the locking element of the carrier member is engaged to the mating receptor of the back frame member such that the decorative facia forms an exterior surface of the dispenser. Other aspects include corresponding systems.

Dispensers made with the above features include many advantages. For example, a dispenser with the above features can change its appearance after it has been installed, e.g., mounted to a wall, by replacing its front cover (or other portion of its housing or all of its housing) with another that has a different design, pattern or appearance. In some instances, this replacement can be accomplished in a single motion to aid the attendant changing covers to do so without undue difficulty.

Historically, changing the appearance of a dispenser would have required removal and replacement of the dispenser, which is costly and often necessitated repairs to the wall where the old dispenser had been mounted (e.g., by screws or adhesive). In contrast, the inventive dispenser described herein can have its aesthetic changed by simple replacement of, for example, the cover, as opposed to the entire dispenser, without need to remove the dispenser from its mounts and possibly repair any damaged caused by such removal.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which:

FIGS. 2 through 5 illustrate one embodiment of a front plate assembly in accordance with the present disclosure wherein FIG. 2 is a plan view of one embodiment of a front plate;

FIG. 3 is a plan view of one embodiment of the back face of the front plate illustrated in FIG. 2;

FIG. 4 is a plan view of one side of a back frame member in accordance with the present disclosure;

FIG. 5 is a plan view of the opposite side of the back frame member illustrated in FIG. 4;

Figure 1:
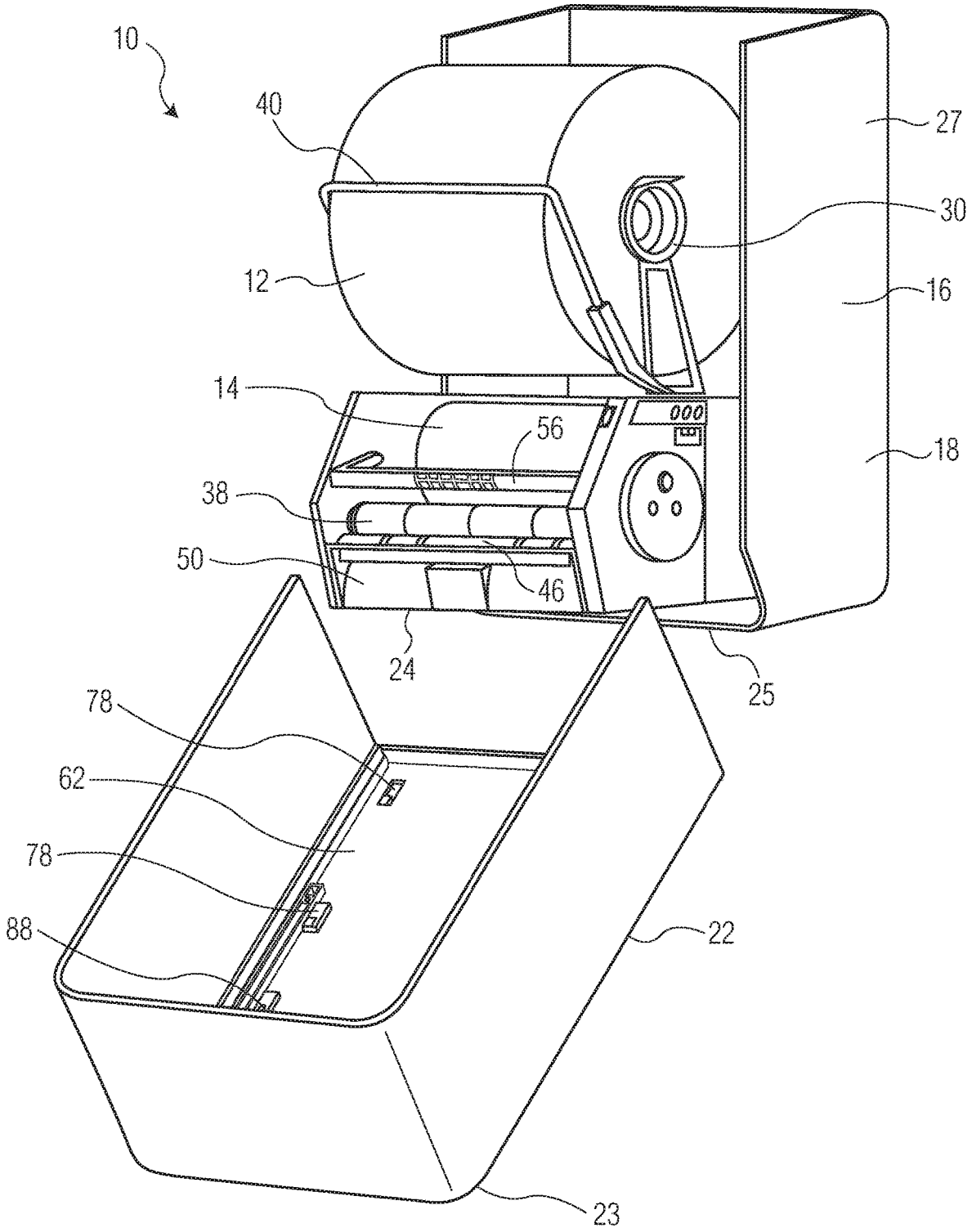
FIG. 1 is a perspective view of one embodiment of a dispenser in accordance with the present disclosure with its front cover in an open position.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

The present disclosure is generally directed to a dispenser for consumable products (e.g., sheet materials such as paper towels and bath tissue and liquid soaps and sanitizers) and/or to a dispenser assembly. The dispenser of the present disclosure allows for flexibility in design offerings and functionality without having to change the entire dispenser system. More particularly, the present disclosure is directed to a dispenser for sheet materials with a modular dispenser front plate and/or shroud design that can be installed at the end-user level. In accordance with the present disclosure, the dispenser is configured to include an exchangeable front plate and/or shroud that can change the aesthetic appeal and/or functionality of the dispenser. For instance, the dispenser includes a front plate that forms the front face and external surface of the dispenser which can be easily switched out and replaced. For example, a user can select a front plate that has a particular desired look and/or can install or replace a front plate with one that can include electronic hardware that can enable various tiered functionality, such as lighting and connectivity.

In one embodiment, the dispenser includes at least a two-part housing having a front cover and a back cover. The front cover can be pivotably connected to the back cover for opening and closing the housing. The front plate assembly and/or shroud of the present disclosure can be integrated into the front of the housing and can be designed such that the front plate and/or shroud can only be removed and replaced by having access to the interior of the housing.

Figure 6:
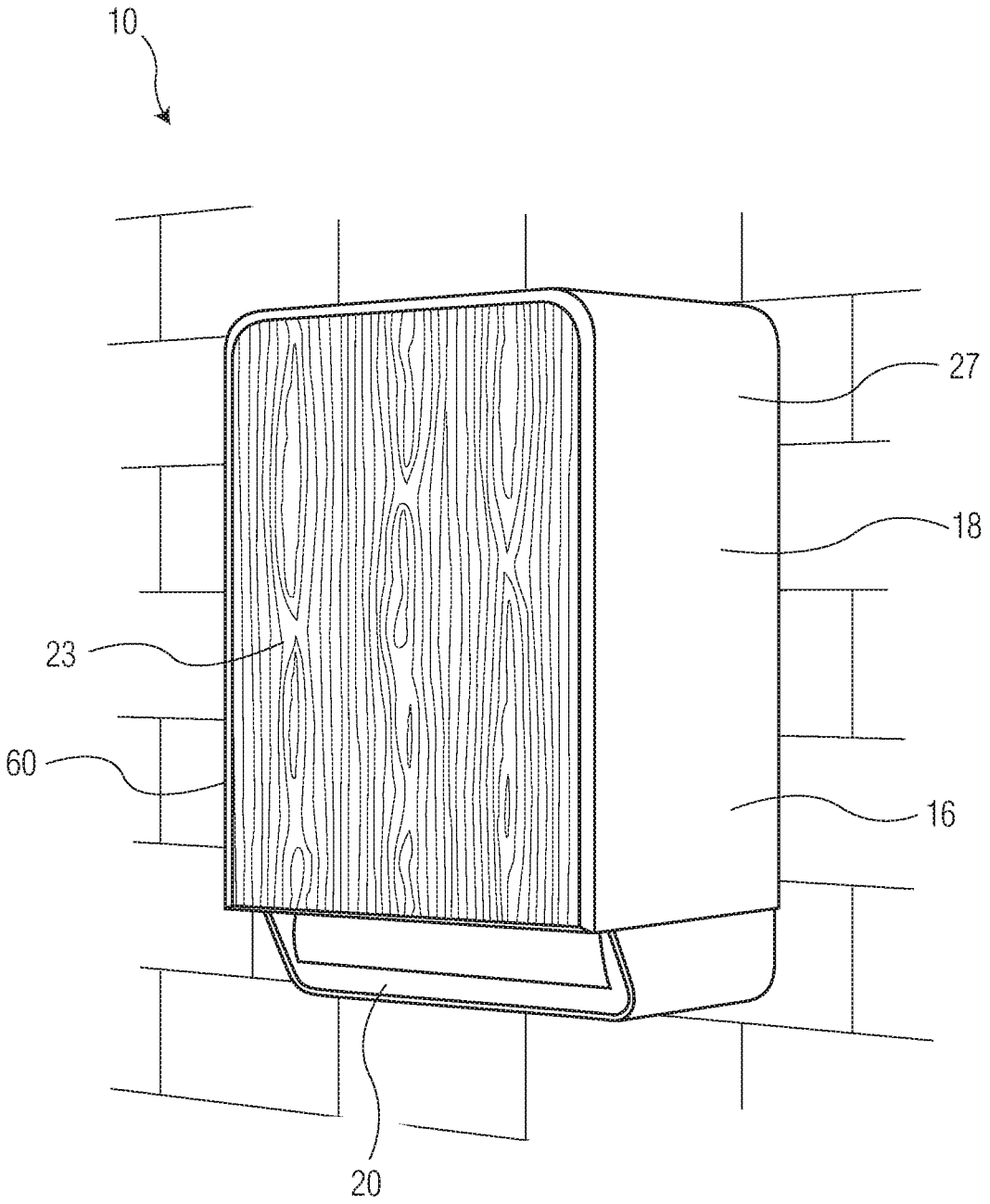
FIG. 6 is a perspective view of one embodiment of a dispenser made in accordance with the present disclosure.
Figure 7:
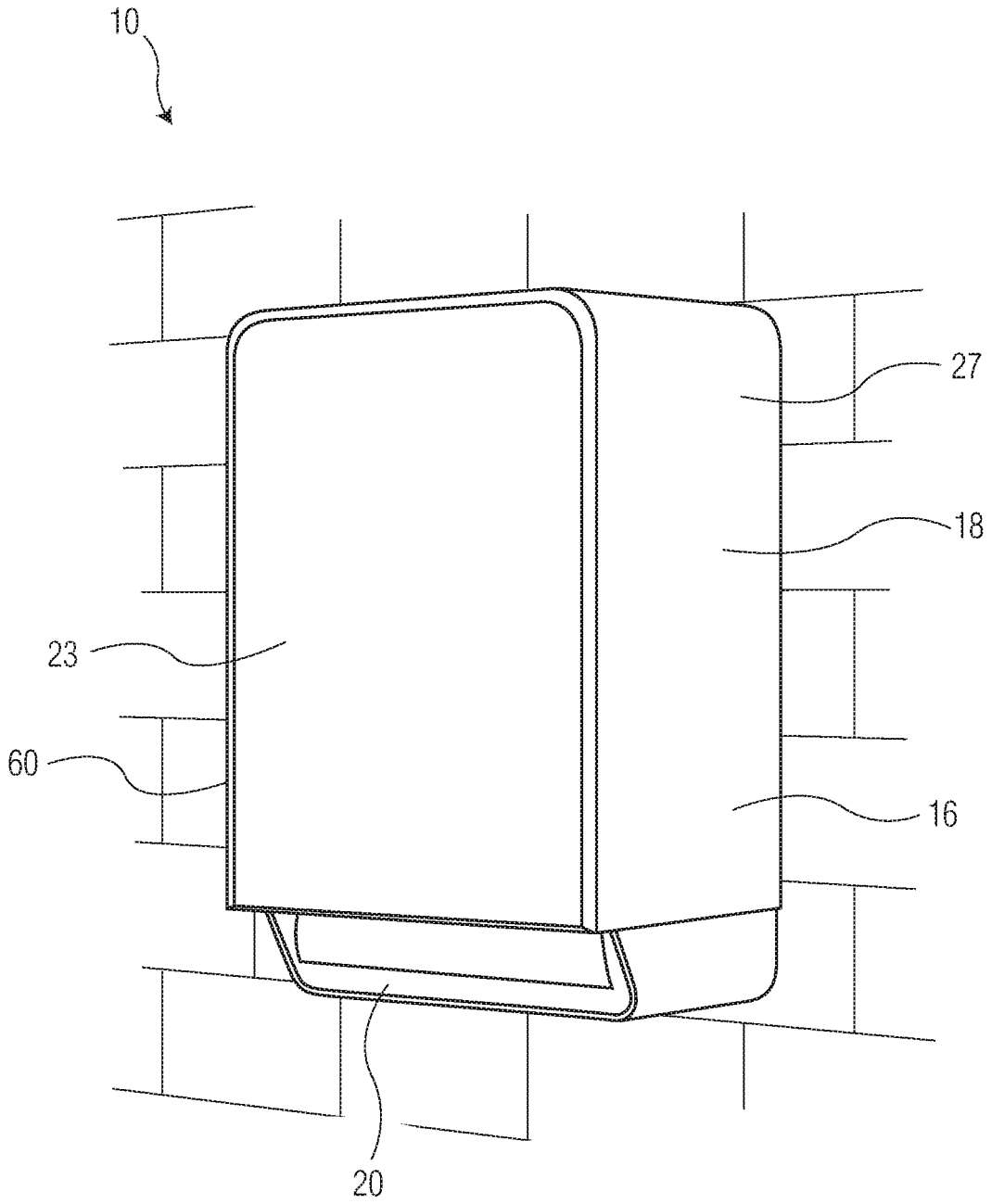
FIG. 7 is a perspective view of another embodiment of a dispenser in accordance with the present disclosure.
Figure 8:
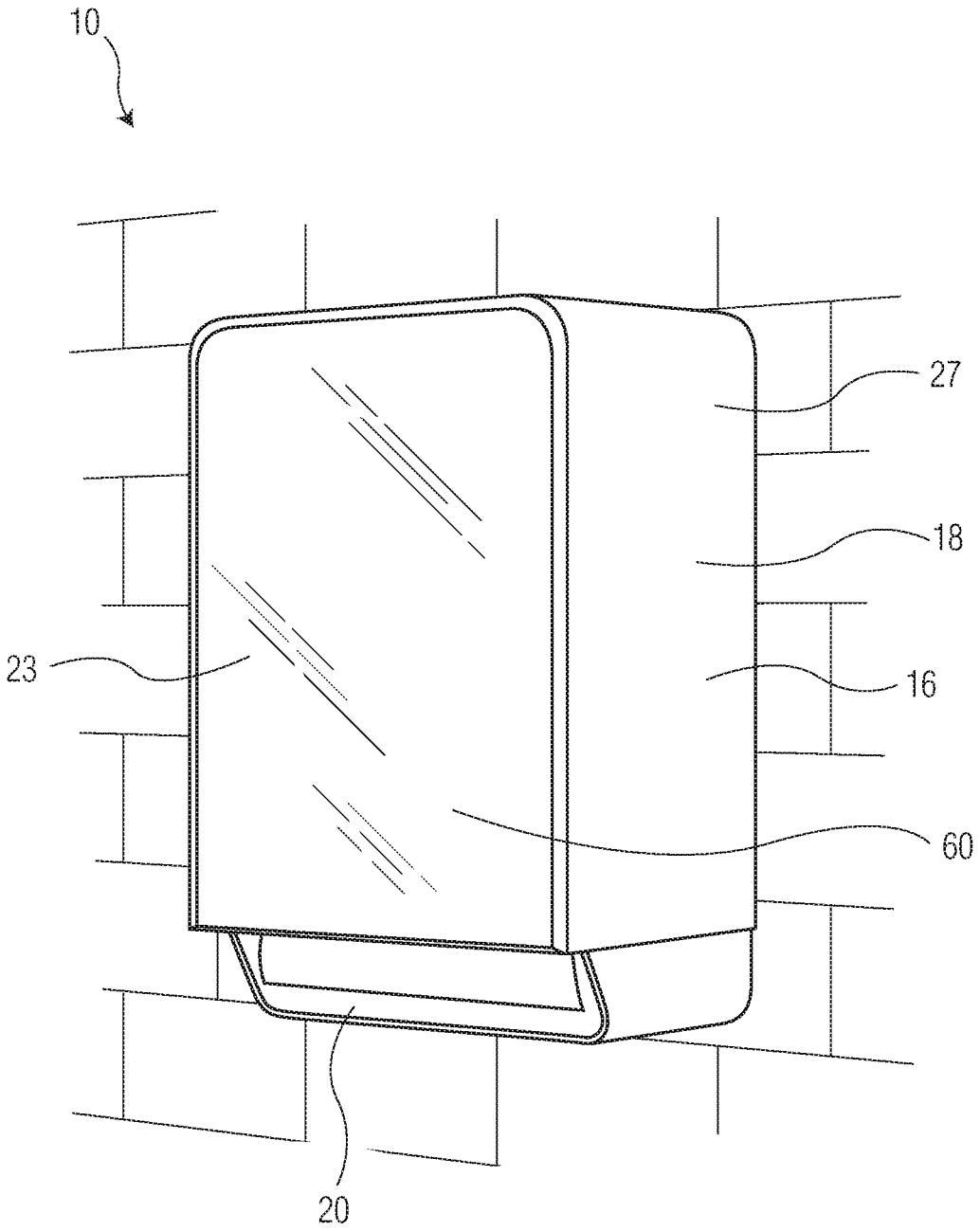
FIG. 8 is a perspective view of another embodiment of a dispenser in accordance with the present disclosure.

Referring particularly to FIGS. 1 and 6-8, various embodiments of a dispenser 10 made according to the present disclosure are illustrated. As shown particularly in FIG. 1, the dispenser 10 includes a housing 16 that can have any desired overall shape. The housing 16 can include a two-part configuration. For example, the housing can include a back cover 18 and a front cover 22. The front cover 22 can be pivotally mounted to the back cover 18 using any suitable means. For example, in one embodiment, hinges can be used to connect the front cover 22 with the back cover 18. Alternatively, the front cover 22 can be completely separable from the back cover 18. The front cover 22 is moveable from a closed position as shown in FIGS. 6-8 to an open position as shown in FIG. 1. The front cover 22 defines a front face 23 while the back cover 18 defines side walls 27. In the embodiment illustrated, the side walls are entirely defined by the back cover 18. In other embodiments, however, the front cover 22 may have walls that form the left and right sides (and/or top of bottom) of the housing 16 when the front cover 22 engages the back cover 18 in a closed position or otherwise cooperate with the side walls 27 of the back cover to define the housing when in the closed configuration. The housing 16 defines an interior volume for housing the operational components of the dispenser 10, as well as the roll or rolls of sheet material to be dispensed, including a main roll 12 and a stub roll 14. In other embodiments the dispenser may house folded sheets, wipes, tissues, wipers, soap, sanitizer, air freshener and the like. The dispenser 10 can also include any conventional locking mechanism 21 for securing the front cover 22 to the back cover 18. The housing 16 further includes an opening 20 through which a sheet material is dispensed. In other embodiments the dispenser may be a dispenser for folded towels, wipes, tissues, wipers, soap, sanitizer, air freshener and the like.

The dispenser configuration 10 illustrated in the figures is merely exemplary for any number of dispenser configurations known to those skilled in the art that may incorporate the front plate assembly of the present disclosure. As such, a detailed explanation of the structural and control features of the dispenser 10 are not necessary for purposes of explanation of the system and method of the present disclosure, and will only be discussed briefly below.

The operational components of the dispenser 10 may be mounted directly to the back cover 18 or can be part of a module that is received within the housing 16. For example, the operational components can be part of a module that may be readily removable from the housing for servicing and/or replacing components without the necessity of having to remove the entire dispenser 10 from its support surface.

As shown in FIG. 1, the operational components can include a pressure roller 46, a transfer mechanism that may include a transfer arm 56, a throat assembly 50 that defines a throat 24, a drive motor and gear assembly that rotates a drive roller 38, and control circuitry which may include a controller or microprocessor.

Left and right main roll holders 30 are attached within the housing and hold the main roll 12 of sheet material. Stub roll holders may be provided for rotatably supporting the stub roll 14 in the position within the housing below the main roll 12. It should be understood that a dispenser according to the present disclosure need not be configured to dispense from a stub roll, and thus would not need a transfer mechanism. The dispenser may be configured for dispensing from a single roll of sheet material.

The pressure roller 46 may be housed within the throat assembly 50 that is, in turn, mounted within the housing. The dispenser 10 may also include a tear bar or cutting bar that is contained within the throat assembly 50 and disposed along the dispensing path of the sheet of material upstream from the dispensing opening 20 and downstream of the nip between the drive roller 38 and the pressure roller 46. To separate a sheet of material that has been dispensed from the dispenser 10, the cutting bar can automatically cut the material or, alternatively, a user can grasp a sheet hanging from beneath a bottom portion of the housing and pulls the sheet against the cutting or tear bar such that the sheet tears and separates along a line defined by the tear or cutting bar.

In some embodiments, the pressure roller 46 is spring biased against the drive roller 38 such that the sheet of material passing between the nip of the rollers is advanced along the dispensing path upon rotation of the drive roller 38. The throat assembly 50 defines a portion of the dispensing path and the forward portion of the dispensing throat 24. The dispenser 10 may further include an automatic transfer mechanism to transfer dispensing of the sheet of material from the stub roll 14 to a main roll 12 when the sheet of material on the stub roll 14 is nearly depleted. Any suitable transfer mechanism may be used. For example, the transfer mechanism may include a transfer bar 56 with arms pivotally mounted. The transfer bar 56 includes a roller section that may be defined by a central curved rib section. The rib section includes a securing mechanism, such as a barb, so that the leading end of the sheet of material from the main roll 12 passes over the rib section and is held by the barb while material is fed from the stub roll 14. The dispenser 10 can also include a stub roll sensing device, such as a sensing bar that is biased towards the axis of the stub roll holders so as to track the decreasing diameter of the stub roll as it is depleted. Alternatively, an electronic sensor can also be used to monitor the stub roll.

The dispenser 10 can also include a spring biased bar 40 that is pivotally mounted within the housing 16 and biased towards the center of the main roll 12 such that the bar 40 tracks a decreasing diameter of the main roll 12 as the sheet of material is depleted. Again, instead of a spring biased bar 40, any suitable electronic sensor may also be used. When the main roll 12 reaches a diameter suitable for moving the roll 12 to the stub roll position, the dispenser 10 can include suitable mechanical elements for moving the main roll 12 into place for dispensing the sheet of material.

The drive roller 38 can be placed in communication with a drive motor and gear assembly. The motor can include a drive shaft and a drive gear attached thereto that engages the shaft of the drive roller 38. Thus, upon energizing the motor, the drive roller 38 is caused to rotate, which results in conveyance of the sheet of material disposed in the nip between the pressure roller 36 and the drive roller 38 along the conveying path and out of the dispensing throat 24.

The dispensing mechanism may be powered by batteries contained in a battery compartment or can be powered by an AC distribution system. If the dispenser 10 includes batteries, a sensor can also be included for determining the power level of the batteries.

As described above, the dispenser 10 can include a controller and control circuitry. The controller and control circuitry can control and monitor all the functions of the dispenser 10 including the length of the sheet of material being dispensed, product usage, and any other activities that are occurring within the dispenser. The controller can be configured to communicate information regarding the dispenser 10 to a central control system via wired means or through a web-based system.

In one embodiment, the dispenser 10 can include a sensor that is designed to detect the presence of a user in a detection zone. Once the presence of a user is detected, the dispenser 10 can be configured to automatically dispense the sheet product. For example, the dispenser 10 can include an infrared sensor to detect when an object, e.g., a user's hand, passes through its sensing zone to trigger the motor to actuate a dispense cycle to deliver sheet material out the throat 24 to the user.

Figure 2:
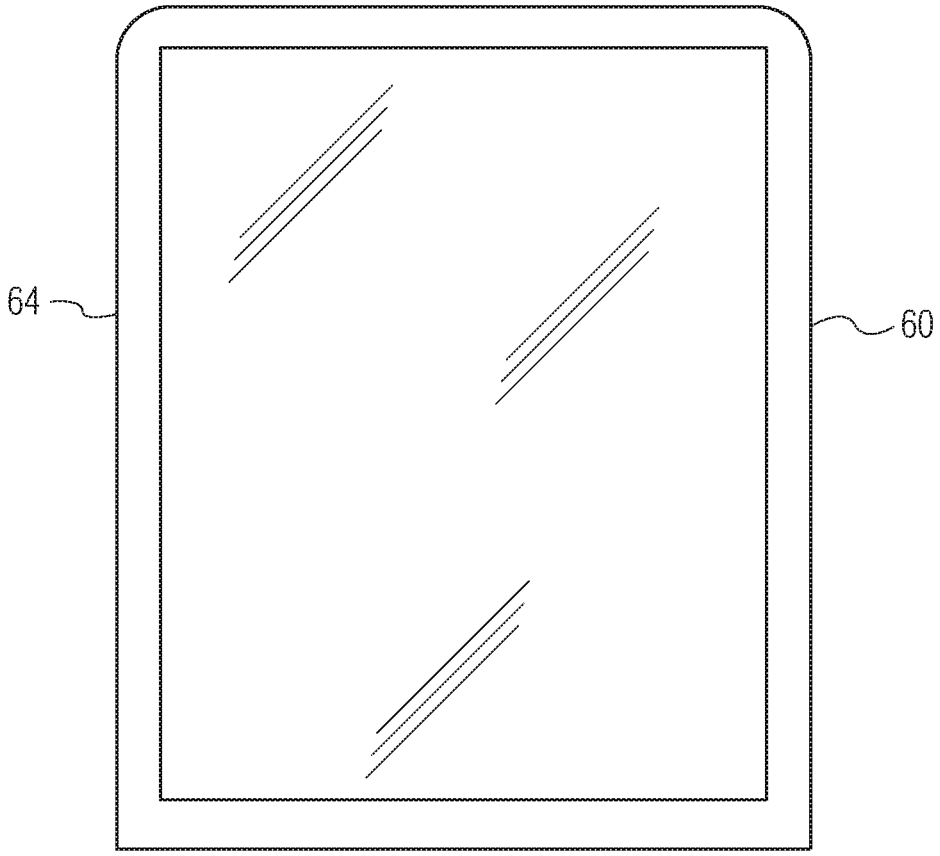
Figure 3:
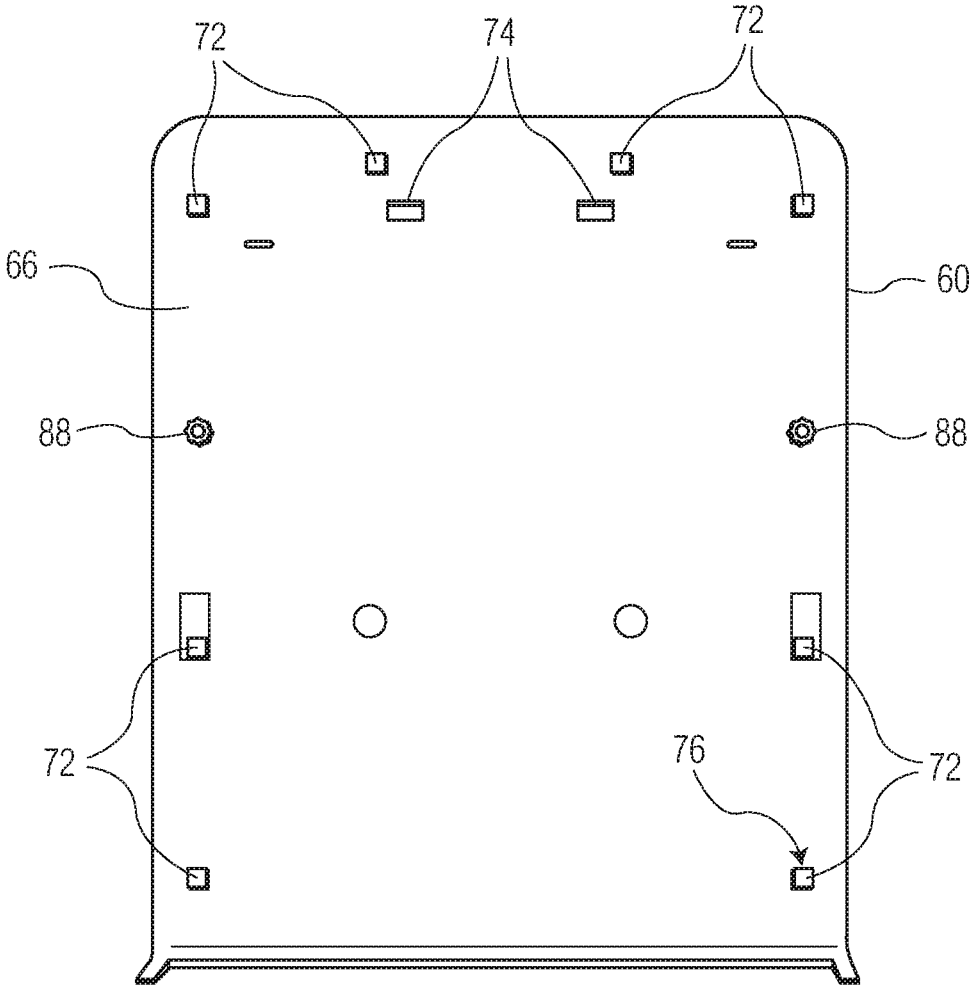
Figure 4:
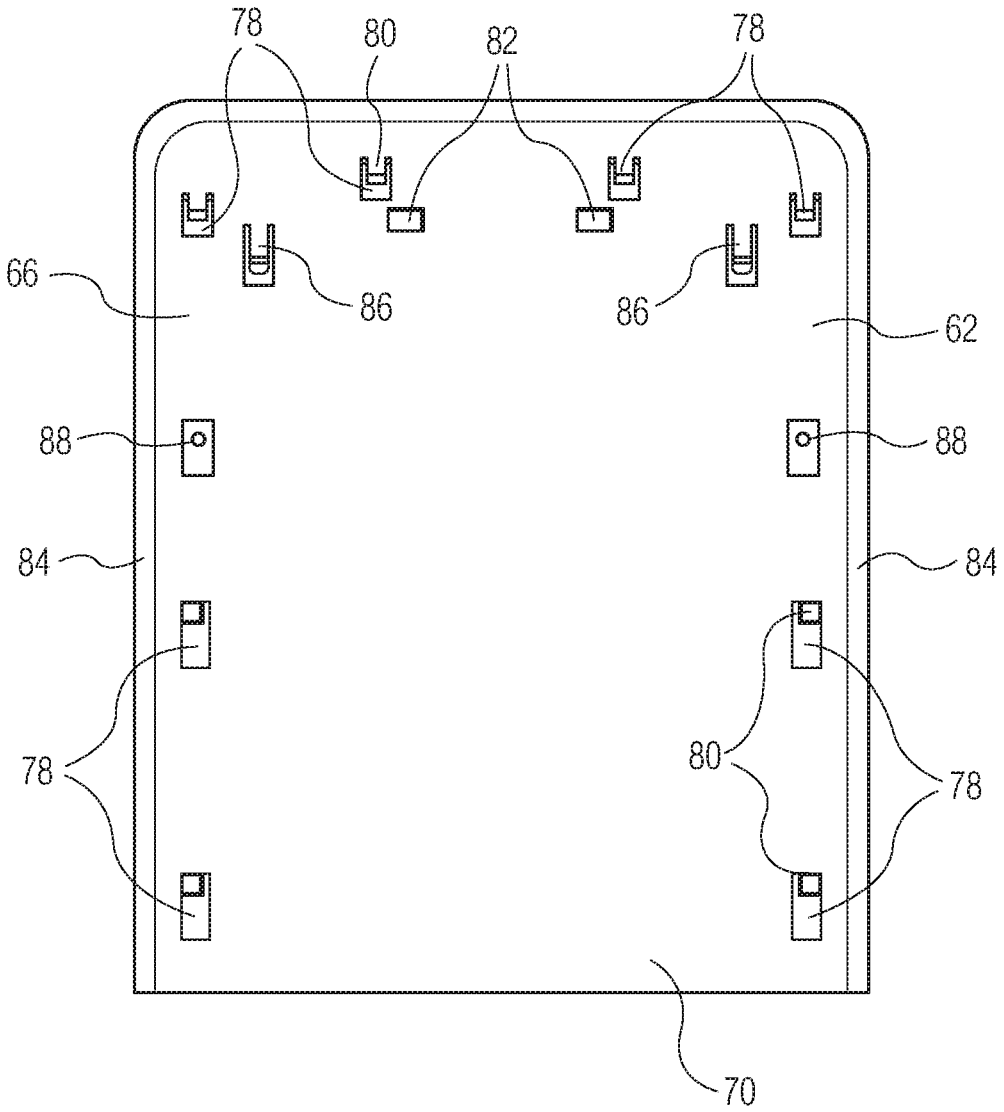
Figure 5:
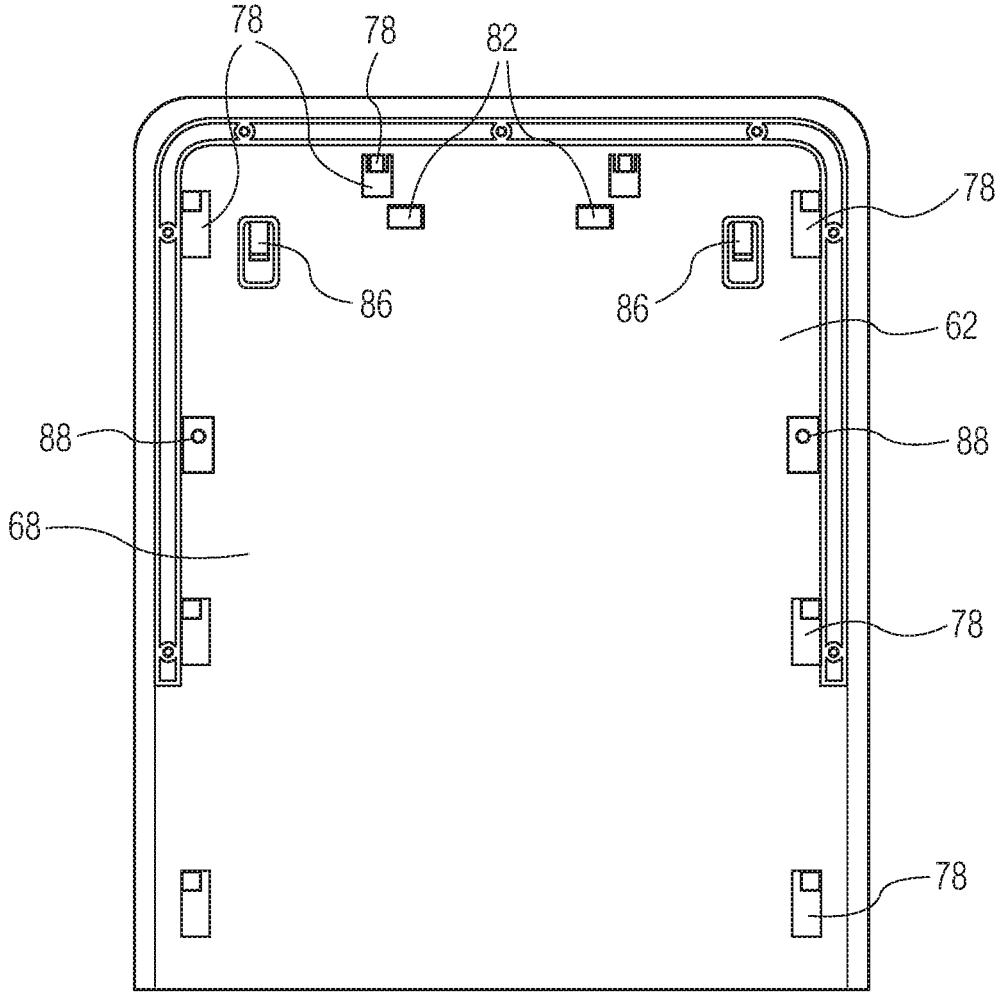

In accordance with the present disclosure, the front cover 22 of the dispenser 10 includes a front plate assembly (also referred to as a cover assembly 22 or a front cover assembly 22) as shown in FIGS. 2-5. More particularly, the front plate assembly includes a front plate or plate 60 that is removably attachable to a back frame member 62. The front plate 60 is illustrated in FIGS. 2 and 3, while the back frame member 62 is illustrated in FIGS. 4 and 5. The front plate 60 includes a first side 64 and a second and opposite side 66. The front side 64 forms an exterior surface of the housing and, in one embodiment, the front face as shown in FIGS. 6-8.

Figure 9:
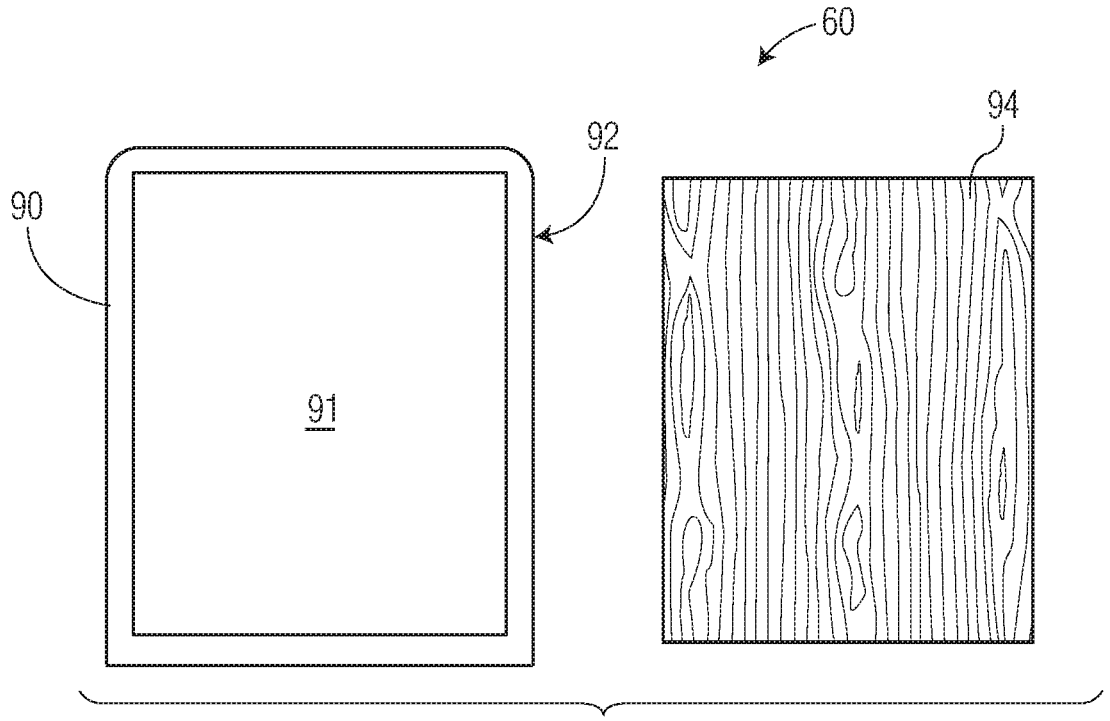
FIG. 9 is a plan view of the front plate.

As shown in FIG. 9, in some embodiments, the plate 60 includes a carrier member 90, primarily made from plastic or metal. Primarily made from a given material means at least fifty percent, preferably at least seventy-five percent and more preferably at least ninety-five percent of the plate 60 is made from the given material. The carrier member 90 has a facia side 91 and a back side opposite the facia side 91, with the back side including at least one locking element, as described in more detail below. The plate 60 also includes a decorative facia 94, and the facia side 91 of the carrier member 90 is coupled to the decorative facia 94 through, for example, an in mold labeling or other decorating or facia application process, an adhesive, or the like such that the decorative facia 94 is externally facing (e.g., visible to dispenser users). In some embodiments the decorative front facia 94 can be less than 100 microns thick, less than 50 microns thick or less than 25 microns thick. However, in other embodiments the carrier member 90 and decorative facia 94 are a unitary piece (i.e., a single piece) with the decorative facia being etched, printed or otherwise, through an additive or subtractive process, displayed on the plate 60.

The front plate 60, through its second side 66, is removably attachable to the back frame member 62. For example, the back frame member 62 can include a first side 68 as shown in FIG. 5 and a second and opposite side 70 as shown in FIG. 4. In some implementations the back frame member 62 includes only an outer perimeter section with the center of the back frame member 62 being primarily open, e.g., to reduce weight and/or manufacturing costs of the back frame member 62. Primarily open means that of the entire area defined by a perimeter of the back frame member 62, more than 50% and preferably more than 75% of the area is open/voided, i.e., is not filled in with material. In these implementations the various attachment points (e.g., mating receptors 78 as described below can be positioned on or proximate the perimeter of the back frame member 62).

The first side 68 of the back frame member 62 forms an interior surface within the dispenser 10. The second side 70 of the back frame member 62, on the other hand, can releasably attach to the second side 66 of the front plate 60. For example, the second side 66 of the front plate 60 can include a plurality of locking elements 72 and one or more alignment tabs 74. In the embodiment illustrated in FIG. 3, the second side 66 of the front plate 60 includes eight locking elements 72. Each locking element 72 can be the same or different. Further, the front plate 60 may include a single locking element or can include any suitable number of locking elements for a particular application. For instance, the front plate 60 can include anywhere from two to ten locking elements, such as four or greater locking elements, such as six or greater locking elements. As shown in FIG. 3, each locking element 72 defines a locking slot 76.

As shown in FIG. 4, the second side 70 of the back frame member 62 includes a corresponding number of mating receptors 78 that are positioned to receive the locking elements 72. As shown in FIG. 4, in one embodiment, each mating receptor 78 can include a locking tab 80. In this manner, each locking element 72 can be received in an opening defined by the mating receptor 78 and then slid so that the locking tabs 80 engage with the slots 76. It should be understood, however, that the mechanical interlock system as shown in FIGS. 3 and 4 can vary depending upon the particular application and the desired result.

As shown in FIG. 3 and as described above, the front plate 60 includes alignment tabs 74. The alignment tabs 74 are configured to engage with alignment slots 82 on the second side 70 of the back frame member 62. The alignment tabs assist in aligning the front plate 60 with the back frame member 62 when placing the front plate 60 onto the back frame member 62 for engagement therewith.

In some embodiments, as shown in FIG. 4 for example, the second side 70 of the back frame member 62 can include a raised margin area 84. The raised margin area 84 forms an exterior surface on the dispenser 10. For example, when the front plate 60 is slid into engagement with the back frame member 62, the front plate 60 forms a flush fit with the raised margin area 84, which not only improves the aesthetic design of the product but also prevents inadvertent release of the front plate 60 from the back frame member 62. The raised margin area 84 surrounds the perimeter of the front plate 60. In the embodiments illustrated in FIGS. 6-8, for instance, three sides of the front plate 60 are surrounded by the raised margin area 84. The front plate 60, however, can have any suitable shape and may not be rectangular. In this regard, the raised margin area 84 may lay adjacent to greater than about 60%, such as greater than about 70%, such as greater than about 75% of the perimeter of the front plate 60. In an alternative embodiment, the raised margin area 84 surrounds the entire perimeter of the front plate 60.

As shown in FIG. 4, the raised margin area 84 can surround at least three sides of the front plate 60 when the front plate 60 is connected to the back frame member 62.

In order to remove the front plate 60 from the back frame member 62, the back frame member 62 can include one or more push pins 86 as shown in FIG. 5. For example, applying pressure to the push pins 86 can lift the front plate 60 over the raised margin area 84 allowing a user to slide the front plate 60 out of engagement with the back frame member 62. In this manner, the front plate 60 can be easily removed and replaced by the end user in a single-motion release action.

Figure 10:
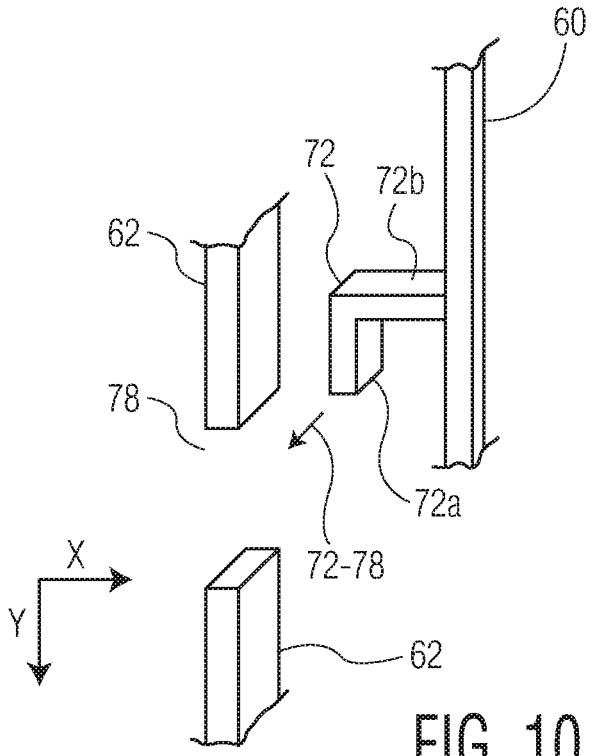
FIG. 10 is a detail view of the plate connecting to the back frame member.

Further, in some embodiments, with or without the raised margin area 84, as shown in FIG. 10, the back frame member 62 includes a corresponding number of mating receptors 78 that are positioned to receive the locking elements 72 such that, once engaged, the mating receptors 78 and locking elements 72 prevent the plate 60 from sliding down towards the ground when the cover assembly is in the closed position, as shown in FIGS. 6-8. More specifically, locking elements 72 may include a top section 72*b* and a bottom section 72*a* and when a locking element 72 engages a corresponding mating receptor 78 the bottom section 72*a* passes into and through an opening in the mating receptor 78 but the top section 72*b* does not thereby preventing the plate 60 from moving further down the y-axis or backing out along the x-axis. Depending on the embodiment there may be multiple pairs of mating receptors 78 and locking elements 72.

Figure 11A:
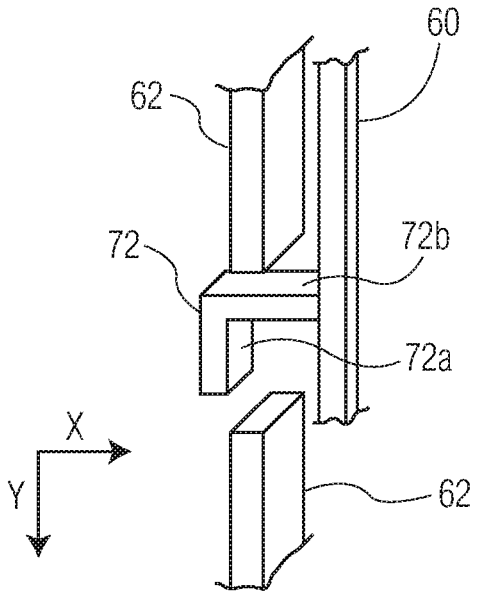
FIGS. 11A-11E are additional detail views of the plate connecting/disconnecting from the back frame member.
Figure 11C:
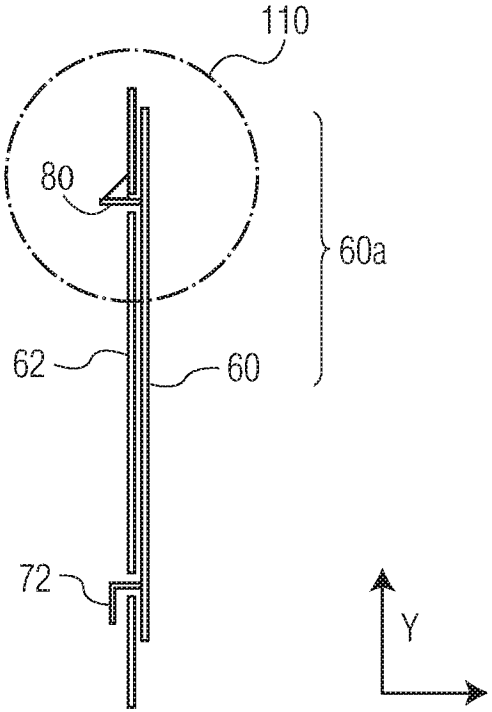
Figure 11B:
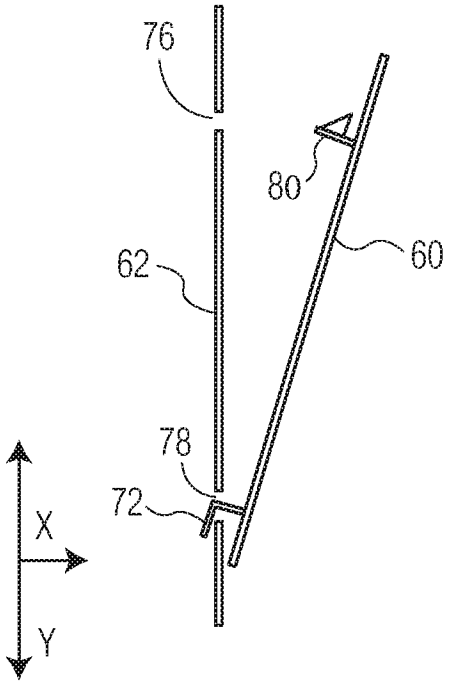
Figure 11D:
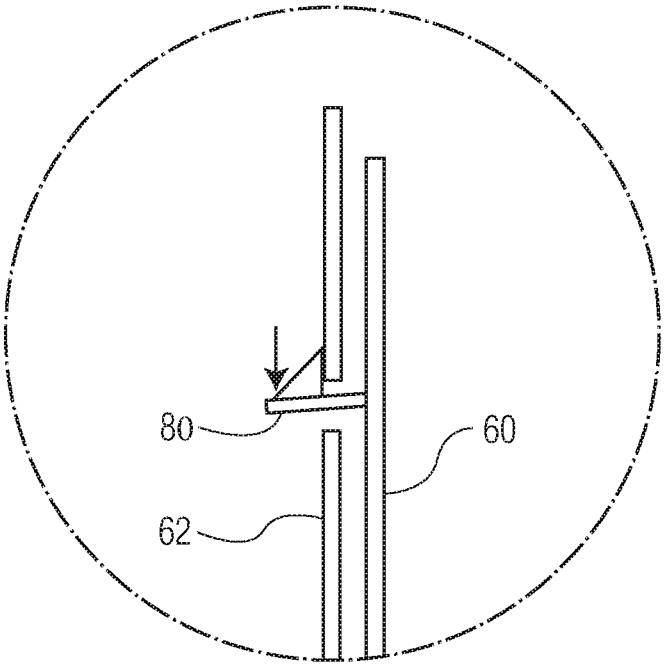

Further, once the pair(s) of mating receptor(s) 78 and locking element(s) 72 are engaged, as shown in FIG. 11A, the plate 60 may be pivoted up to engage the locking tabs 80 with the corresponding alignment slots 76, for example, in a snap fit type engagement that biases the plate 60 down along the y-axis to prevent the mating receptors 78 and locking elements 72 from disengaging. A detail view of the engagement of a locking tab 80 and an alignment slot 76 is shown in FIG. 11D. This arrangement secures the plate 60 to the back frame member 62/housing 16, as shown starting in FIG. 11B and completing in FIG. 11C. Further, in this way, the plate 60 can be attached to the back frame member 62/housing 16 in a single-motion installation step, i.e., sliding the locking element(s) 72 into the mating receptor(s) 78 as the top section of the plate 60 is pivoted towards the back frame member 62 to engage the locking tabs 80 with the alignment slot(s) 76.

Figure 11E:
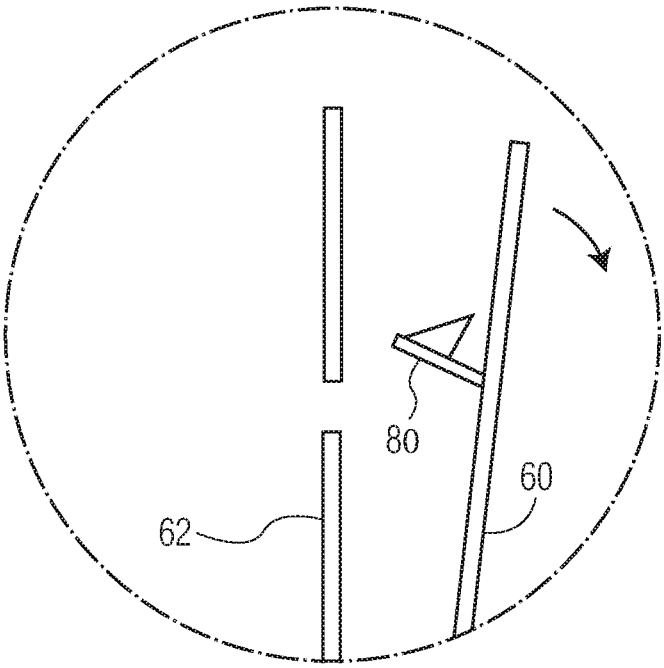

To remove the plate 60 from the housing 16, for example, to replace the current plate 60 with a plate 60 having a different aesthetic design, a user disengages the locking tabs 80 from the alignment slot(s) 76, as shown in FIG. 11E by pushing down on the locking tabs 80, to allow the top section of the plate 60*a* to pivot away from the back frame member 62, while simultaneously lifting the plate 60 up and away from the back frame member 62 (e.g., up along the y-axis and out/to the right along the x-axis, with reference to FIG. 11A) to disengage the mating receptors 78 from the locking elements 72. Thus with a single-motion action, the locking tabs 80 can be disengaged from the alignment slot(s) 76 and/or the locking elements 72 can be released from the mating receptors 78 to remove the plate 60 from the back frame member 62.

In addition, as described above, in order to remove the front plate 60, one would need to open the dispenser housing 16 in order to access the locking tabs 80. Having the locking tabs 80 located on the interior surface of the housing 16 prevents against inadvertent removal of the front plate 60 and allows removal of the front plate 60 only when the housing 16 is unlocked and opened (e.g., by an authorized service attendant).

In addition to mechanically connecting the front plate 60 to the back frame member 62, the dispenser 10 can also be configured so that the front plate 60 becomes electrically connected to a controller and a power supply within the dispenser 10 when attached to the back frame member 62. For example, in one embodiment, the locking elements 72 and the mating receptors 78 may create an electrical connection in addition to a mechanical connection using appropriate wiring. In an alternative embodiment, the front plate assembly can include electrical conduits 88 that extend from the second side 66 of the front plate 60 as shown in FIG. 3 and through the back frame member 62 as shown in FIGS. 3 and 4. The one or more electrical conduits 88 can receive appropriate wiring for making electrical connections.

In this regard, the front plate 60 can have electronic functionality. For example, the front plate 60 may comprise an electronic display, capable of displaying graphics and images. In addition, the front plate 60 can be equipped with an audio speaker for emitting music, instructions, news, or any other information. In one embodiment, for instance, the front plate 60 can be connected to a controller for displaying television or cable channels, commercials, or any other media content.

In other embodiments, the front plate 60 may be designed to provide an overall look or appearance. For instance, in FIG. 6, the front plate 60 has a woodgrain finish. In FIG. 7, the front plate 60 has a metallic finish. In FIG. 8, on the other hand, the front plate 60 has a mirrored finish. In other embodiments, the front plate 60 can have any desirable color, such as silver, black (onyx), or any color that may match the interior of the room in which the dispenser is located. The front plate 60 can also include trademarks and decorative designs.

In one embodiment, the present disclosure is directed to a dispenser assembly that includes a dispenser as shown in FIG. 1 in combination with a plurality of front plates 60 that each have a different appearance and/or functionality. An end user can then select the front plate to be installed and displayed for a particular purpose or period of time. The end user can also switch out the different front plates as desired.

Figure 12B:
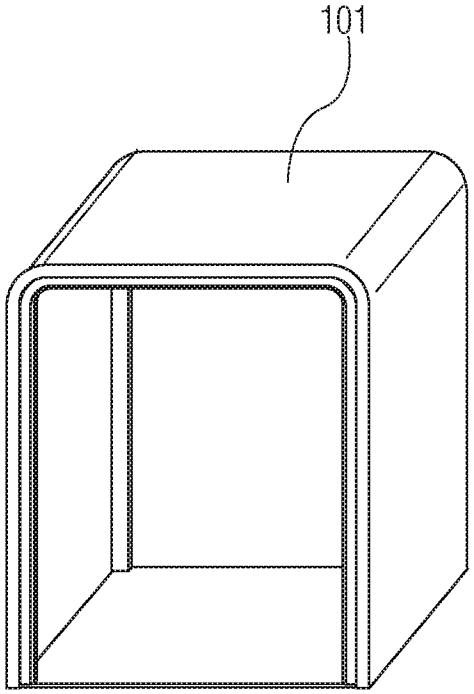
FIG. 12B is another perspective view of the dispenser of FIG. 12A.
Figure 12A:
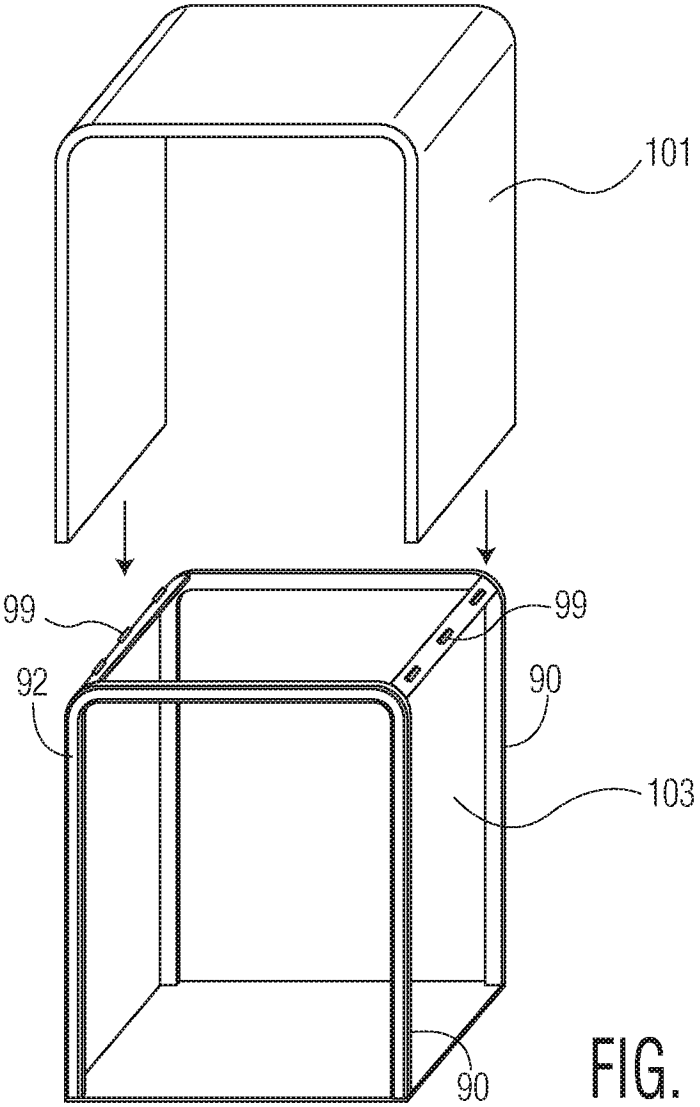
FIG. 12A is a perspective view of another embodiment of a dispenser.

In some implementations, as described above, the dispenser 16 includes a front cover 22. In some implementations, with reference to FIGS. 12A and 12B, the front cover 22 can be defined by a frame 92 and a shroud 101 (and in some implementations the front plate 60). The frame 92 forms the mechanical backbone or skeleton of the front cover 22 (e.g., gives the front cover 22 its strength and general shape), but does not include a top (or back 103), left or right or front surface to close in the front cover 22. The shroud 101 serves to give the front cover 22 its top and sides (and in some implementations a front side similar in concept and operation to the plate 60). In some implementations the shroud 101 is a U-shaped cover that drops down over (and releasably connects to) the frame 92 to aid in enclosing the frame 92 to form the front cover 22. As such, the shroud 101 can be easily removed and replaced with another shroud, e.g., of a different aesthetic like the plate 60. Thus, in some implementations, the dispenser 10 includes a changeable plate 60, a changeable shroud 101 or both.

In some implementations, the frame 92 includes mating receptors 99 (similar to mating receptors 78) and the shroud 101 includes locking elements (not shown) similar to locking elements 72 to hold the shroud 101 on the frame 92, preferably such that the shroud 101, like the plate 60, can only be removed when the dispenser 10 is open, e.g., by an authorized service attendant. In some implementations the shroud 101 also (or alternatively) is attached to the frame 92 through screws, bolts or other mechanical fasteners or adhesives or the like, but, in any event, designed to be removable to change shrouds 101.

In some implementations the plate 60 and/or shroud 101 are made from a biodegradable and/or compostable material such as or including a cellulosic material. Preferably the plate 60 and/or shroud 101 could be made from a moldable (e.g., through an injection molding process), biodegradable material.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A dispenser for sheet materials comprising:

a housing having an interior volume configured to hold sheet material, the housing primarily made from plastic and including a front cover comprising a cover assembly, wherein the cover assembly comprises:

a back frame member comprising a first side and a second and opposite side, the second side of the back frame member forming an interior surface of the housing, and the first side of the back frame member comprising at least one mating receptor; and a plate comprising a carrier member, primarily made from plastic, and a decorative facia, wherein the carrier member has a facia side coupled to the decorative facia and a back and opposite side, including a locking element and a locking tab, wherein the plate is configured to be removably coupled to the first side of the back frame member when the locking element and the locking tab of the carrier member is releasably engaged to the mating receptor of the back frame member such that the decorative facia forms an exterior surface of the dispenser, wherein a bottom section of the locking element engages with the second side of the back frame member, wherein a bottom section of the locking tab engages with the second side of the back frame member, wherein the back frame member includes one or more push pins and a raised margin area surrounding at least three sides of the perimeter of the front plate, wherein the front cover surrounds the back frame member.

2. The dispenser for sheet materials of claim 1, wherein the plate is configured to be removed from the back frame when the dispenser is installed for use.

3. The dispenser for sheet materials of claim 1, wherein the decorative facia and carrier member are integral.

4. The dispenser for sheet materials of claim 3, wherein the decorative facia is etched into the carrier member.

5. The dispenser for sheet materials of claim 1, wherein the decorative facia is a separate element from the carrier member and is less than 50 microns thick.

6. The dispenser for sheet materials of claim 1, wherein the decorative facia is an in-mold label.

7. The dispenser for sheet materials of claim 1, wherein the locking element and mating receptor are single-motion releasable.

8. The dispenser for sheet materials of claim 1, wherein the cover assembly is a front cover assembly of the housing.

9. The dispenser for sheet materials of claim 8, wherein the plate is in a plane parallel to a mounting surface of the dispenser, wherein the plate is in a plane that is coplanar with the raised margin area of the back frame member.

10. The dispenser for sheet materials of claim 9, wherein in the mounting surface is a vertically oriented wall.

11. A dispenser for sheet materials of claim 1, wherein the decorative facia has a mirrored or a metallic finish.

12. The dispenser for sheet materials of claim 1, wherein the locking element comprises an orientation in a first direction and the locking tab comprises an orientation in a second direction.

13. The dispenser for sheet materials of claim 1, wherein the locking tab comprises a bendable member.

14. The dispenser for sheet materials of claim 1 wherein the back frame member comprises an alignment slot, wherein the locking tab and the alignment slot together comprise a snap fit type engagement.

15. A method comprising:

opening a cover of a dispenser housing of a dispenser, wherein the dispenser housing has an interior volume configured to hold sheet material, wherein the housing is made primarily from plastic and wherein the cover comprises a back frame member comprising a first side and a second and opposite side, the second side of the back frame member forming an interior surface of the housing, and the first side of the back frame member comprising at least one mating receptor; and removing a front plate, comprising a carrier member primarily made from plastic and a decorative facia, from the cover, wherein the carrier member has a facia side coupled to the decorative facia and a back and opposite side, including a locking element and a locking tab, and the front plate is releasably attached to the first side of the back frame member when the locking element and the locking tab of the carrier member is engaged to the mating receptor of the back frame member such that the decorative facia forms an exterior surface of the dispenser, wherein a bottom section of the locking element engages with the second side of the back frame member, wherein a bottom section of the locking tab engages with the second side of the back frame member, wherein the back frame member includes one or more push pins and a raised margin area surrounding at least three sides of the perimeter of the plate, wherein the cover surrounds the back frame member.

16. The method of claim 15, wherein removing the front plate from the cover comprises releasing the locking element from the mating receptor in a single-motion operation.

17. The method of claim 15, wherein the dispenser is installed in an end user facility and the first face plate has a first decorative design, and the method comprising attaching a second face plate having a second decorative design, different from the first decorative design, to the cover.

18. The method of claim 15, wherein decorative facia has a mirrored or a metallic finish.

19. The method of claim 15, wherein the back side of the front plate includes at least four locking elements that correspond in location and connect to at least four mating receptors on the first side of the back frame.

20. The method of claim 15, wherein the back side of the front plate includes at least six locking elements that correspond in location and connect to at least six mating receptors on the first side of the back frame.

21. The method of claim 15, wherein the decorative facia is an in-mold label.

22. A dispenser for sheet materials comprising:

a housing having an interior volume configured to hold sheet material, the housing primarily made from plastic and including a front cover comprising a cover assembly, wherein the cover assembly comprises:

a back frame member comprising a first side and a second and opposite side, the second side of the back frame member forming an interior surface of the housing and being primarily open, and the first side of the back frame member comprising at least one mating receptor; and a plate comprising a carrier member and a decorative facia, wherein the carrier member has a facia side coupled to the decorative facia and a back and opposite side, including a locking element and a locking tab, wherein the plate is configured to be removably coupled to the first side of the back frame member when the locking element and the locking tab of the carrier member is releasably engaged to the mating receptor of the back frame member such that the decorative facia forms an exterior surface of the dispenser, wherein a bottom section of the locking element engages with the second side of the back frame member, wherein a bottom section of the locking tab engages with the second side of the back frame member, wherein the back frame member includes one or more push pins and a raised margin area surrounding at least three sides of the perimeter of the plate, wherein the front cover surrounds the back frame member.

23. The dispenser of claim 22 comprising a frame that includes the back frame member and a shroud that releasably engages the frame to cover at least a top and left and right side of the frame, excluding covering the back frame member covered by the plate.

24. The dispenser of claim 22, wherein the plate is primarily made from metal.

25. The dispenser of claim 22, wherein the plate is primarily made from plastic.

26. The dispenser of claim 22, wherein the plate is primarily made from a biodegradable material.

* * * * *